US009444189B1

(12) United States Patent
Sattazahn et al.

(10) Patent No.: US 9,444,189 B1
(45) Date of Patent: Sep. 13, 2016

(54) PLUGGABLE CONNECTOR CONFIGURED FOR CROSSTALK REDUCTION AND RESONANCE CONTROL

(71) Applicant: Tyco Electronics Corporation, Berwyn, PA (US)

(72) Inventors: Steve Douglas Sattazahn, Lebanon, PA (US); Matthew Ryan Schmitt, Middletown, PA (US); Bruce Allen Champion, Camp Hill, PA (US); Brandon Michael Matthews, McAlisterville, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 14/721,732

(22) Filed: May 26, 2015

(51) Int. Cl.
*H01R 13/6461* (2011.01)
*H01R 13/66* (2006.01)

(52) U.S. Cl.
CPC ..... *H01R 13/6461* (2013.01); *H01R 13/665* (2013.01)

(58) Field of Classification Search
CPC ..... H01R 3/6461; H01R 3/665
USPC ..... 439/92, 620.22, 660, 607.08, 607.1, 439/497
See application file for complete search history.

(56) References Cited

U.S. PATENT DOCUMENTS 5,453,026 A * 9/1995 Ikegami ..... H01R 23/688 439/579
7,462,071 B1 * 12/2008 Wu ..... H01R 9/032 439/497
7,758,379 B2 * 7/2010 Chen ..... H01R 13/6485 439/607.11
8,764,464 B2 7/2014 Buck et al.
9,039,457 B2 * 5/2015 Zhang ..... H01R 13/6275 439/357
9,318,856 B2 * 4/2016 MacDougall ..... H01R 13/6581
2002/0022401 A1 * 2/2002 Ramey ..... H01R 13/65807 439/607.1
2010/0081334 A1 * 4/2010 Kagotani ..... H01R 12/716 439/639
2010/0291798 A1 * 11/2010 Kondo ..... H01R 13/65807 439/607.08
2012/0142200 A1 * 6/2012 Ito ..... H01R 13/6471 439/65
2013/0089991 A1 * 4/2013 Ito ..... H01R 12/721 439/65
2014/0065856 A1 * 3/2014 Regnier ..... H01R 13/6658 439/108
2015/0072546 A1 * 3/2015 Li ..... H01R 13/6585 439/96
2015/0079819 A1 * 3/2015 Tamai ..... H01R 12/7082 439/101
2015/0126069 A1 * 5/2015 Little ..... H01R 24/60 439/607.55
2015/0244118 A1 * 8/2015 Lin ..... H01R 24/60 439/357
2016/0013599 A1 * 1/2016 Ueda ..... H01R 13/6596 439/607.01

OTHER PUBLICATIONS

TE Connectivity, CFP Transceiver Connector Assembly, Application Specification, Feb. 4, 2013, pp. 1-7 Tyco Electronics Corporation, USA.

* cited by examiner

*Primary Examiner* — Abdullah Riyami
*Assistant Examiner* — Nelson R Burgos-Guntin

(57) ABSTRACT

Pluggable connector includes a module body having a mating plug that is configured to be inserted into a receptacle assembly during a mating operation. The mating plug has first and second plug sides that face in opposite directions and a front edge that joins the first and second plug sides. The pluggable connector also includes a plurality of signal contacts that are positioned along the first and second plug sides and a ground plate disposed within the mating plug. The ground plate is positioned between the signal contacts along the first plug side and the signal contacts along the second plug side. The pluggable connector also includes a plurality of resonance-control blades disposed within the mating plug and extending between the ground plate and at least one of the first plug side or the second plug side. The resonance-control blades have edge projections that engage the ground plate.

20 Claims, 8 Drawing Sheets

PLUGGABLE CONNECTOR CONFIGURED FOR CROSSTALK REDUCTION AND RESONANCE CONTROL

BACKGROUND

The subject matter herein relates generally to pluggable connectors that have signal contacts configured to convey data signals and ground contacts that control impedance and reduce crosstalk between the signal contacts.

Communication systems exist today that utilize pluggable cable assemblies to transmit data. For example, network systems, servers, data centers, and the like may use numerous cable assemblies to interconnect the various devices of the communication system. Cable assemblies may include a pluggable connector that is configured to be inserted into a receptacle assembly. The pluggable connector includes signal contacts and ground contacts in which the signal contacts convey data signals and the ground contacts control impedance and reduce crosstalk between the signal contacts. In differential signaling applications, the signal contacts are arranged in signal pairs for carrying the data signals. Each signal pair may be separated from an adjacent signal pair by one or more ground contacts.

There has been a general demand to increase the speeds at which data is transmitted through the communication systems. As data rates increase, however, it becomes more challenging to maintain a baseline level of signal quality. For example, crosstalk may occur between adjacent signal contacts or adjacent signal pairs. In addition to crosstalk, electrical energy that flows along the surface of each ground contact may form a field that propagates between the ground contacts. The fields may couple with each other to support an unwanted electrical propagation mode that is repeatedly reflected and forms a resonating condition (or standing wave). Electrical noise caused by the resonating condition may increase return loss and/or crosstalk and reduce throughput.

To reduce the electrical noise, it has been proposed to electrically common the ground contacts using a metal conductor or a lossy plastic material. The effectiveness and/or cost of implementing these techniques is based on a number of variables, such as the geometries of the signal and ground contacts within the pluggable connector. These techniques, however, may not sufficiently reduce the crosstalk that occurs between signal contacts or signal pairs.

Accordingly, there is a need for pluggable connectors that reduce crosstalk between signal contacts and reduce electrical noise caused by resonating conditions in ground contacts.

BRIEF DESCRIPTION

In an embodiment, a pluggable connector is provided that includes a module body having a mating plug that is configured to be inserted into a receptacle assembly during a mating operation. The mating plug has first and second plug sides that face in opposite directions and a front edge that joins the first and second plug sides. The front edge leads the mating plug into the receptacle assembly during the mating operation. The pluggable connector also includes a plurality of signal contacts that are positioned along the first and second plug sides. The pluggable connector also includes a ground plate disposed within the mating plug. The ground plate extends parallel to and between the first and second plug sides. The ground plate is positioned between the signal contacts along the first plug side and the signal contacts along the second plug side. The pluggable connector also includes a plurality of resonance-control blades disposed within the mating plug and extending between the ground plate and at least one of the first plug side or the second plug side. The resonance-control blades have edge projections that engage the ground plate.

In some embodiments, the resonance-control blades have outer edges. The outer edges may be one of (a) exposed along the first and second plug sides and interleaved between the signal contacts or (b) engaged to discrete ground contacts of the pluggable connector that are positioned along the first and second plug sides and interleaved between the signal contacts.

In an embodiment, a pluggable connector is provided that includes a module body having a mating plug that is configured to be inserted into a receptacle assembly during a mating operation. The mating plug has first and second plug sides that face in opposite directions and a front edge that joins the first and second plug sides. The front edge leads the mating plug into the receptacle assembly during the mating operation. The pluggable connector also includes signal and ground contacts positioned along the first plug side and along the second plug side. The ground contacts are interleaved between the signal contacts. The pluggable connector also includes a ground plate extending parallel to and between the first and second plug sides through the mating plug. The ground plate is positioned between the signal and ground contacts along the first plug side and the signal and ground contacts along the second plug side. The pluggable connector also includes a plurality of resonance-control blades that are disposed within the mating plug and extend between the ground plate and at least one of the first plug side or the second plug side. The resonance-control blades have inner edges that engage the ground plate and outer edges that engage corresponding ground contacts.

In an embodiment, a pluggable connector is provided that includes a module body having a mating plug that is configured to be inserted into a receptacle assembly during a mating operation. The mating plug has first and second plug sides that face in opposite directions and a front edge that joins the first and second plug sides. The front edge leads the mating plug into the receptacle assembly during the mating operation. The pluggable connector also includes signal contacts positioned along the first and second plug sides. The pluggable connector also includes a ground plate disposed within the mating plug. The ground plate extends parallel to and between the first and second plug sides. The ground plate is positioned between the signal contacts along the first plug side and the signal contacts along the second plug side. The pluggable connector also includes a plurality of resonance-control blades that are disposed within the mating plug and extend between the ground plate and the first plug side. Each resonance-control blade has an inner edge that engages the ground plate and an outer edge that is exposed along the first plug side. The outer edges are coplanar with and interleaved between the signal contacts along the first plug side. Each of the inner edges of the resonance-control blades has an edge projection that engages the ground plate.

DETAILED DESCRIPTION

Figure 1:
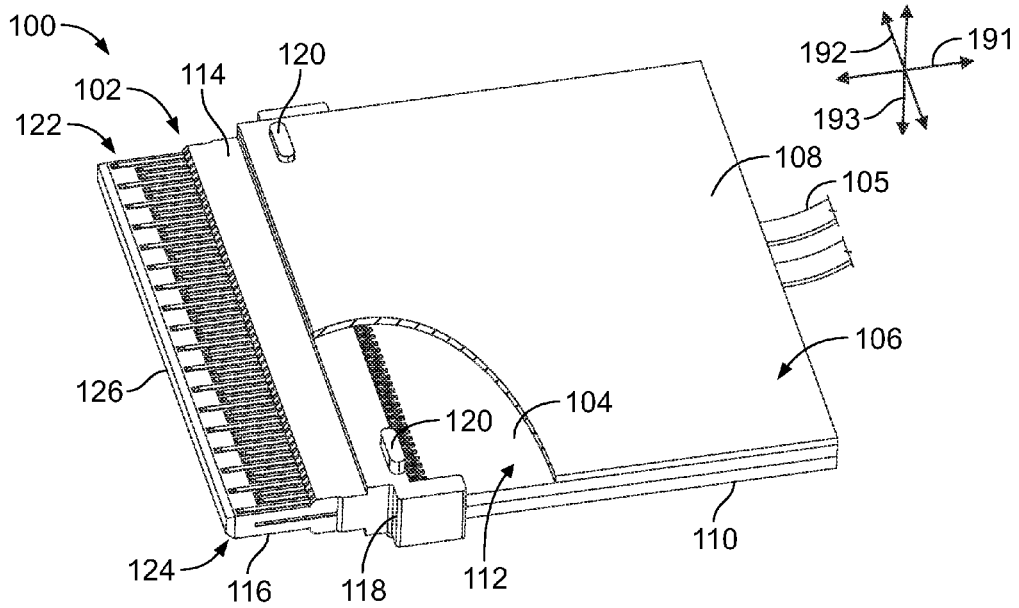
FIG. 1 is a perspective view of a pluggable cable assembly that includes a pluggable connector formed in accordance with an embodiment.

Embodiments set forth herein include various pluggable electrical connectors (referred to herein as pluggable connectors) that are configured for communicating data signals. Embodiments may also include cable assemblies or interconnection systems that include the pluggable connectors. The pluggable connectors are configured to mate with a corresponding mating connector, such as a receptacle connector within a receptacle assembly. The pluggable connectors have signal and ground contacts that are configured to engage corresponding contacts of the mating connector. The pluggable connectors also include at least one ground plate and a plurality of resonance-control blades. The resonance-control blades electrically interconnect the ground contacts of the pluggable connector to the ground plate, thereby electrically commoning the ground contacts. To this end, the resonance-control blades optionally include one or more edge projections that engage the ground plate and/or a corresponding ground contact. As used herein, an "edge projection" may include protuberances or bumps along an edge of the resonance-control blade or a flexible spring finger that is defined at least partially by the edge of the resonance-control blade. The ground plate and the resonance-control blades may operate to reduce crosstalk between signal contacts (or signal pairs) and impede development of resonating conditions.

For embodiments that include signal pairs, the signal and ground pathways may form multiple sub-arrays. Each sub-array includes, in order, a ground pathway, a signal pathway, a signal pathway, and a ground pathway. This arrangement is referred to as ground-signal-signal-ground (or GSSG) sub-array. The sub-array may be repeated such that an exemplary row of conductors may form G-S-S-G-G-S-S-G-G-S-S-G, wherein two ground pathways are positioned between two adjacent signal pairs. In the illustrated embodiment, however, adjacent signal pairs share a ground conductor such that the pattern forms G-S-S-G-S-S-G-S-S-G. In both examples above, the sub-array may be referred to as a GSSG sub-array. More specifically, the term "GSSG sub-array" includes sub-arrays that share one or more intervening ground conductors.

Various embodiments are particularly suitable for high-speed communication systems, such as network systems, servers, data centers, and the like, in which the data rates may be greater than four (4) gigabits/second (Gbps). Particular embodiments may be configured to transmit data at a rate of at least about 10 Gbps, at least about 20 Gbps, at least about 28 Gbps, at least about 56 Gbps, or more. In this context, the term "configured to" does not mean mere capability in a hypothetical or theoretical sense, but means that the embodiment is designed to transmit data at the designated rate for an extended period of time and at a signal quality that is sufficient for its intended commercial use. It is noted, however, that other embodiments may be configured to operate at transmission speeds or data rates that are less than 4 Gbps.

Various embodiments may also be configured for certain applications. Non-limiting examples of such applications include host bus adapters (HBAs), redundant arrays of inexpensive disks (RAIDs), workstations, servers, storage racks, high performance computers, or switches. Embodiments may also be configured to be compliant with certain standards, such as, but not limited to, the small-form factor pluggable (SFP) standard, enhanced SFP (SFP+) standard, quad SFP (QSFP) standard, C form-factor pluggable (CFP) standard, and 10 Gigabit SFP standard, which is often referred to as the XFP standard.

As used herein, phrases such as "a plurality of [elements]" and "an array of [elements]" and the like, when used in the detailed description and claims, do not necessarily include each and every element that a component may have. The component may have other elements that are similar to the plurality of elements. For example, the phrase "a plurality of resonance-control blades [being/having a recited feature]" does not necessarily mean that each and every resonance-control blade of the component has the recited feature. Other resonance-control blades may not include the recited feature. Accordingly, unless explicitly stated otherwise (e.g., "each and every resonance-control blade [being/having a recited feature]"), embodiments may include similar elements that do not have the recited features.

FIG. 1 is a perspective view of a cable assembly 100 including a pluggable connector 102. The cable assembly 100 also includes a circuit board 104 that is communicatively coupled to the pluggable connector 102 and an assembly housing 106 that surrounds the circuit board 104 and is coupled to the pluggable connector 102. A portion of the assembly housing 106 has been removed to reveal the circuit board 104 within a housing cavity 112 defined by the assembly housing 106. The cable assembly 100 also includes a plurality of communication cables 105. In an exemplary embodiment, the communication cables 105 are optical cables, but the communication cables 105 may include electrical conductors in other embodiments. Although not shown, the cable assembly 100 may include an optical/electrical (O/E) converter within the housing cavity 112 that is mounted to the circuit board 104 and converts electrical signals to optical signals and vice versa.

In the illustrated embodiment, the assembly housing 106 includes a pair of housing shells 108, 110 that are coupled to form the housing cavity 112 that receives the circuit board 104. The pluggable connector 102 has a module body 114 that includes a mating plug 116 and a loading portion 118. The loading portion 118 includes coupling projections 120 that engage the assembly housing 106 to couple the assembly housing 106 to the module body 114. The mating plug 116 is configured to be inserted into a receptacle assembly (not shown).

For reference, the cable assembly 100 is oriented with respect to mutually perpendicular axes 191, 192, 193, including a mating axis 191, a lateral axis 192, and an elevation axis 193. The mating plug 116 has first and second plug sides 122, 124 that face in opposite directions along the elevation axis 193 and a front edge 126 that joins the first and second plug sides 122, 124. The front edge 126 leads the mating plug 116 into a receiving cavity (not shown) of the receptacle assembly.

Figure 2:
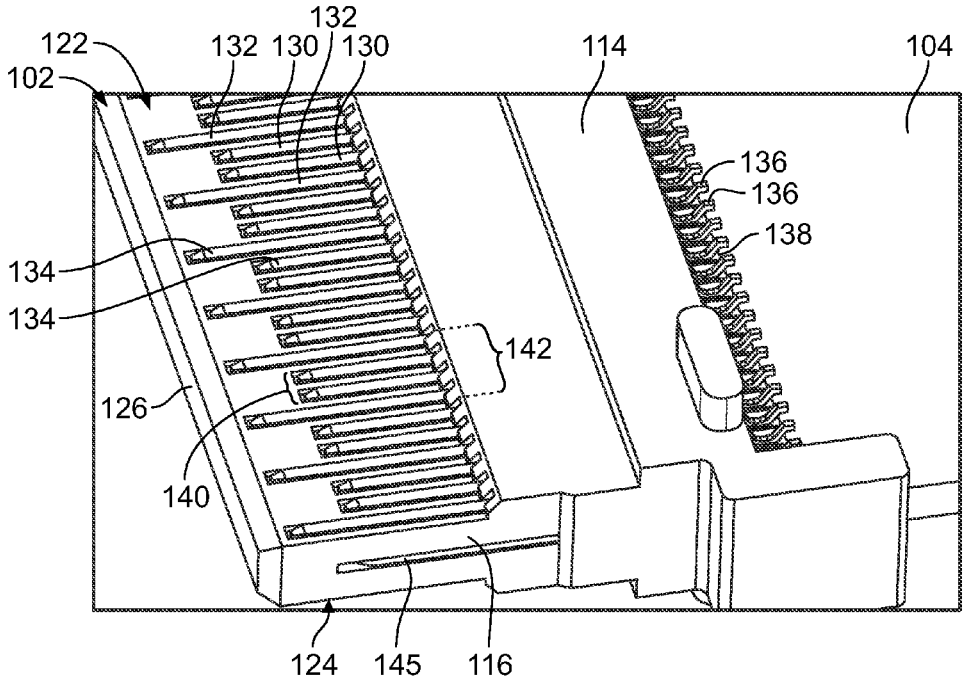
FIG. 2 is an enlarged perspective view of the pluggable connector of FIG. 1 coupled to a circuit board.

FIG. 2 is an enlarged perspective view of a portion of the pluggable connector 102 coupled to the circuit board 104. The pluggable connector 102 includes signal contacts 130 and ground contacts 132 positioned along the first and second plug sides 122, 124 of the mating plug 116. The signal and ground contacts 130, 132 extend between corresponding mating ends or tips 134 and corresponding terminating segments 136. The mating ends 134 are positioned proximate to the front edge 126 of the module body 114. As shown, the mating ends 134 of the ground contacts 132 are closer to the front edge 126 than the mating ends 134 of the signal contacts 130. The signal and ground contacts 130, 132 may be stamped and formed from sheet metal (e.g., copper).

The terminating segments 136 of the signal and ground contacts 130, 132 are terminated to contact pads 138 of the circuit board 104. For example, the terminating segments 136 may be mechanically and electrically coupled to the corresponding contact pads 138 through soldering or welding. The contact pads 138 may be electrically coupled to the O/E converter (not shown) or other processing units mounted to the circuit board 104 through traces and/or vias (not shown).

In the illustrated embodiment, the signal and ground contacts 130, 132 include elongated strips of the sheet metal that have similar sizes and shapes. For example, the signal and ground contacts 130, 132 may have similar cross-sectional dimensions (e.g., thickness and width). In other embodiments, however, the ground contacts 132 may be ground blades (or resonance-control blades) in which the ground blades have substantially greater widths or thicknesses than the signal contacts and extend a depth into the mating plug 116. Such ground blades may have outer edges that are interleaved between the signal contacts 132 and are configured to engage corresponding contacts of the receptacle assembly (not shown). Such embodiments are described with respect to the pluggable connector 400 (shown in FIG. 10).

In the illustrated embodiment, the signal contacts 130 are arranged to form signal pairs 140. The ground contacts 132 are interleaved between the signal pairs 140. As shown, the signal and ground contacts 130, 132 are arranged in a repeating pattern such that a single ground contact 132 is interleaved between two signal pairs 140. In other embodiments, the signal and ground contacts 130, 132 are arranged in a repeating pattern such that two ground contacts 132 are interleaved between two signal pairs 140. In either of the above examples, the signal and ground contacts 130, 132 may form GSSG sub-arrays 142 in which each signal pair 140 is flanked on both sides by one or more ground contacts 132. In alternative embodiments, the signal contacts 130 may not be arranged in signal pairs 140.

As described in greater detail below, the pluggable connector 102 may include one or more shield-bus assemblies 145 disposed within the module body 114. Each shield-bus assembly 145 is configured to electrically separate the signal contacts 130 of the first plug side 122 and the signal contacts 130 of the second plug side 124 thereby reducing crosstalk. In addition to reducing crosstalk, the shield-bus assembly 145 is configured to impede the development of resonating conditions by the ground contacts 132. To this end, the shield-bus assembly 145 may electrically common at least some of the ground contacts 132 of the pluggable connector 102. To determine whether a configuration of a ground plate and corresponding resonance-control blades sufficiently reduces crosstalk and sufficiently impedes development of resonating conditions, one may perform calculations and/or conduct simulations of a proposed design. Alternatively or in addition to the calculations and/or simulations, the configuration may be determined through multiple tests or trials of the pluggable connector.

Figure 3:
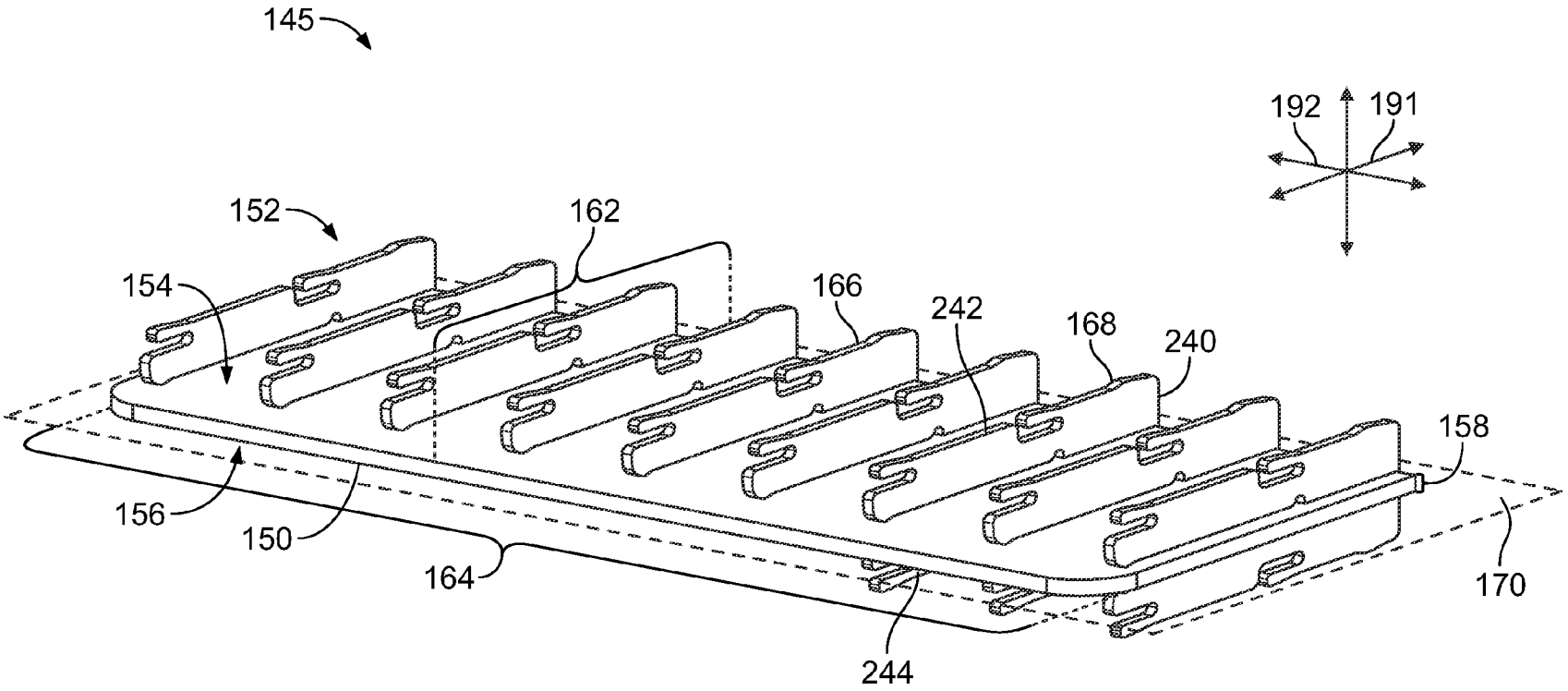
FIG. 3 is an isolated perspective view of a shield-bus assembly that may be used with the pluggable connector of FIG. 1.

FIG. 3 is a perspective view of the shield-bus assembly 145 that is configured to be disposed within the module body 114 (FIG. 1). The shield-bus assembly 145 includes a ground plate 150 and a plurality of resonance-control blades 152 that are positioned along and electrically coupled to the ground plate 150. The ground plate 150 is configured to electrically shield the signal contacts 130 (FIG. 2) along the first plug side 122 (FIG. 1) from noise or crosstalk generated by the signal contacts 130 along the second plug side 124 (FIG. 1) and vice versa. The resonance-control blades 152 are configured to electrically common the ground contacts 132 (FIG. 2) to the ground plate 150 in order to impede or disrupt the development of resonating conditions. In an exemplary embodiment, the ground plate 150 is stamped from sheet metal, and the resonance-control blades 152 are stamped from sheet metal. However, the ground plate 150 and the resonance-control blades 152 may be formed by one or more other processes, such as molding, plating, and/or die-casting. In the illustrated embodiment, the ground plate 150 and the resonance-control blades 152 are discrete elements that are coupled to one another. It is contemplated, however, that the ground plate 150 and the resonance-control blades 152 may be shaped from a common sheet of material or formed from a common mold in other embodiments.

The ground plate 150 has first and second plate sides 154, 156 that face in opposite directions and a thickness 158 that extends between the first and second plate sides 154, 156. The first plate side 154 is configured to face toward the first plug side 122 (FIG. 1). The second plate side 156 is configured to face toward the second plug side 124 (FIG. 1). The ground plate 150 also has a first dimension 162 that is measured along the mating axis 191, and a second dimension 164 that is measured along the lateral axis 192. In the illustrated embodiment, the ground plate 150 coincides with a plate plane 170 that is parallel to the mating and lateral axes 191, 192. In other embodiments, the ground plate 150 may have a non-planar shape. For example, the ground plate 150 may be shaped to form two or more levels or may be shaped to include structural projections that, for example, engage the module body 114 (FIG. 1).

The resonance-control blades 152 include resonance-control blades 166 that exist along only one of the plate sides. For example, the shield-bus assembly 145 includes six (6) resonance-control blades 166 that are positioned along the first plate side 154. The resonance-control blades 152 may also form blade clips (or dual blades) 168 in which each blade clip 168 includes first and second resonance-control sections 242, 244 and a base section 240 that joins the first and second resonance-control sections 242, 244. The shield-bus assembly 145 includes three (3) blade clips 168. As described below, the resonance-control blades 166 and the blade clips 168 are configured to be attached to the ground plate 150 and held in a designated position relative to the ground plate 150.

Figure 4:
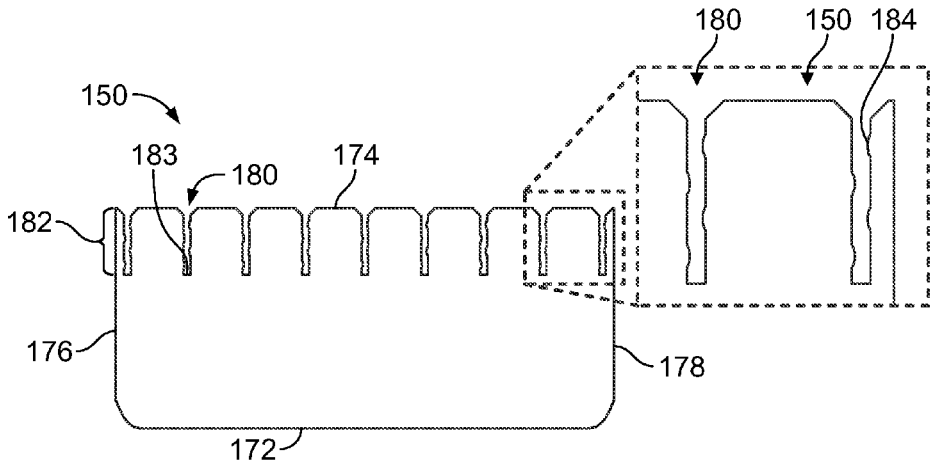
FIG. 4 is a plan view of a ground plate that may be used with the shield-bus assembly of FIG. 3.

FIG. 4 is an isolated plan view of the ground plate 150. The ground plate 150 includes a first plate edge 172, a second plate edge 174, and side edges 176, 178 that extend between the first and second plate edges 172, 174. In an exemplary embodiment, the first plate edge 172 is a leading plate edge that is positioned proximate to the front edge 126 (FIG. 1). However, in other embodiments, the second plate edge 174 may be the leading plate edge. As shown, the ground plate 150 has a substantially rectangular profile. In alternative embodiments, the ground plate 150 may have profiles with other shapes.

In the illustrated embodiment, the ground plate 150 has a plurality of blade slots 180 that are accessed along the second plate edge 174. The blade slots 180 extend a slot distance 182 from the second plate edge 174 to a blocking edge 183. The blade slots 180 are sized and shaped to receive corresponding resonance-control blades 152 (FIG. 2). As shown in the magnified view in FIG. 4, the ground plate 150 includes protuberances or bumps 184 that project into corresponding blade slots 180. The protuberances 184 are configured to frictionally engage corresponding resonance-control blades 152 (FIG. 2).

Figure 5:
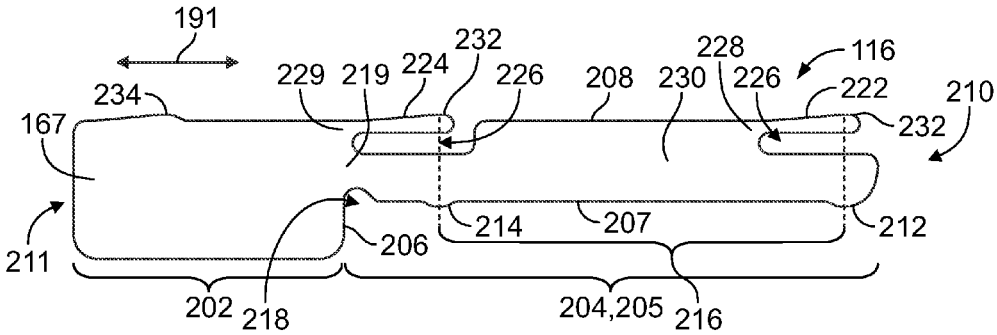
FIG. 5 is a plan view of a resonance-control blade that may be used with the shield-bus assembly of FIG. 3.

FIG. 5 is a plan view of an exemplary resonance-control blade 166. The resonance-control blade 166 has a blade body 167 that includes a base section 202 and a resonance-control section 204 that is coupled to the base section 202. The resonance-control section 204 represents a portion of the resonance-control blade 166 that is configured to interface with the ground plate 150 (FIG. 3) and the corresponding ground contact 132 (FIG. 2). The base section 202 may represent a portion of the resonance-control blade 166 that is directly coupled to the ground plate 150. For example, the base section 202 is received within the blade slot 180 (FIG. 4) of the ground plate 150 and frictionally engaged to the protuberances 184 (FIG. 4). It is noted that the sizes and shapes of the base and resonance-control sections 202, 204 in FIG. 5 are only exemplary and other sizes and shapes may be used in alternative embodiments.

The base section 202 has a base edge 206 that is configured to be received within the blade slot 180 (FIG. 4) and interface with the blocking edge 183 (FIG. 4). The resonance-control section 204 extends a length 205 from the base edge 206 to a leading end 210 of the blade body 167 (or the resonance-control section 204). The resonance-control section 204 includes an inner edge 207 that is configured to directly interface with the ground plate 150 (FIG. 3). The inner edge 207 extends along the mating axis 191 from the base edge 206 to the leading end 210 of the resonance-control section 204. The blade body 167 includes an outer edge 208 that extends along the base section 202 and the resonance-control section 204. The outer edge 208 extends from a trailing end 211 of the blade body 167 to the leading end 210. The outer edge 208 is configured to directly interface with a corresponding ground contact 132 (FIG. 2).

The resonance-control section 204 is shaped to facilitate establishing at least one contact area between the resonance-control section 204 and the ground plate 150 (FIG. 3) and at least one contact area between the resonance-control section 204 and the corresponding ground contact 132 (FIG. 2). In the illustrated embodiment, the resonance-control section 204 is shaped to establish multiple contact areas with each of the ground plate 150 and the corresponding ground contact 132. To this end, the resonance-control section 204 may include edge projections that engage another conductive component. As used herein, "edge projections" include rigid projections (e.g., bumps) and flexible spring fingers. For example, the inner edge 207 has first and second edge projections 212, 214 that are each configured to engage the ground plate 150.

Also shown in FIG. 5, the inner edge 207 includes a recess or notch 218 that partially defines a neck or joint 219 that joins the resonance-control section 204 and the base section 202. The recess 218 effectively reduces an amount of material at the neck 219. In such embodiments, the neck 219 may allow at least a small amount of flexing by the resonance-control section 204 relative to the base section 202 when the resonance-control section 204 engages the ground plate 150 (FIG. 3).

The outer edge 208 is also configured to establish one or more contact areas with the corresponding ground contact 132 (FIG. 2). For example, the outer edge 208 may include one or more outer edge projections. As shown, the outer edge projections are first and second spring fingers 222, 224. Each of the first and second spring fingers 222, 224 includes a portion of the outer edge 208 and is separated from a main portion 230 of the resonance-control section 204 by a gap or opening 226. The first and second spring fingers 222, 224 extend generally parallel to the mating axis 191 when the resonance-control blade 166 is positioned within the module body 114 (FIG. 1).

The first spring finger 222 is located proximate to the leading end 210. The second spring finger 224 is located proximate to the neck 219. The first spring finger 222 extends from a finger base 228 that connects the first spring finger 222 to the main portion 230 of the resonance-control section 204. The second spring finger 224 extends from a finger base 229 that connects the second spring finger 224 to the base section 202. Each of the first and second spring fingers 222, 224 has a finger surface 232 that represents an inflection point of the outer edge 208. The finger surfaces 232 are configured to engage the corresponding ground contact 132 (FIG. 2).

In the illustrated embodiment, the finger surfaces 232 of the first and second spring fingers 222, 224 are separated by a working distance 216 measured along the mating axis 191. In some embodiments, the working distance 216 is at least half of the length 205 of the resonance-control section 204. In certain embodiments, the working distance 216 is at least 75% of the length 205 of the resonance-control section 204. In other embodiments, the working distance 216 may be less than half of the length 205. In other embodiments, the resonance-control section 204 includes only one edge projection (e.g., spring finger) or more than two edge projections along the outer edge 208. In alternative embodiments, the resonance-control section 204 include edge projections along the outer edge 208 that are similar to the edge projections 212, 214 along the inner edge 207.

Also shown in FIG. 5, the base section 202 includes an edge projection 234 along the outer edge 208. Accordingly, the edge projection 234 and the finger surfaces 232 are configured to establish an electrical connection between the corresponding ground contact 132 (FIG. 2) and the resonance-control blade 166. The locations of the edge projection 234 and the finger surfaces 232 may be configured to achieve a designated electrical performance. For example, the locations of the edge projection 234 and the finger surfaces 232 may be configured to impede the development of resonating conditions by the ground contacts 132. Likewise, the first and second edge projections 212, 214 along the inner edge 207 are configured to establish an electrical connection between the ground plate 150 and the resonance-control blade 166. In some embodiments, the locations of the first and second edge projections 212, 214 may be configured to achieve a designated electrical performance.

Figure 6:
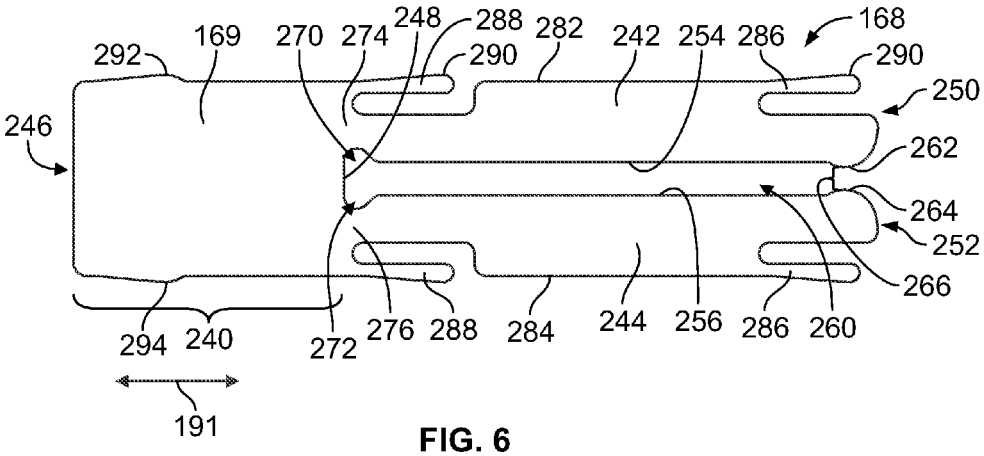
FIG. 6 is a plan view of a resonance-control blade that may be used with the shield-bus assembly of FIG. 3.

FIG. 6 is a plan view of an exemplary blade clip (or dual blade) 168. The blade clip 168 is configured to engage the ground plate 150 (FIG. 3), a corresponding ground contact 132 (FIG. 2) along the first plug side 122 (FIG. 1), and a corresponding ground contact 132 along the second plug side 124 (FIG. 1). The blade clip 168 may include features that are similar or identical to features of the resonance-control blade 166 (FIG. 5). The blade clip 168 has a clip body 169 that includes a base section 240 and first and second resonance-control sections 242, 244. The base section 240 includes a trailing end 246 of the clip body 169 and a base edge 248 that extends between the first and second resonance-control sections 242, 244. The first and second resonance-control sections 242, 244 project from the base edge 248 to respective leading ends 250, 252 in a direction that is parallel to the mating axis 191. The first and second resonance-control sections 242, 244 have inner edges 254, 256, respectively. The inner edges 254, 256 face each other and define a plate-receiving slot 260 therebetween.

The inner edges 254, 256 have respective edge projections 262, 264. The edge projections 262, 264 may have similar locations along the inner edges 254, 256, respectively, that are proximate to the leading ends 250, 252, respectively. The edge projections 262, 264 may directly oppose each other and define a slot opening 266 therebetween. The ground plate 150 (FIG. 3) is configured to be advanced through the slot opening 266. Also shown, the first and second resonance-control sections 242, 244 may define respective recesses or notches 270, 272. The recesses 270, 272 partially define corresponding necks 274, 276. The neck 274 joins the first resonance-control section 242 to the base section 240, and the neck 276 joins the second resonance-control section 244 to the base section 240. The recesses 270, 272 effectively reduce the sizes of the corresponding necks 274, 276 to allow at least a small amount of flexing by the first and second resonance-control sections 242, 244, respectively, relative to the base section 240.

The clip body 169 also includes outer edges 282, 284 that partially define the base section 240 and the first and second resonance-control sections 242, 244, respectively. The outer edges 282, 284 are configured to establish one or more contact areas with the corresponding ground contacts 132 (FIG. 2). For example, each of the first and second resonance-control sections 242, 244 is shaped to form first and second spring fingers 286, 288. The first and second spring fingers 286, 288 may be similar or identical to the spring fingers 222, 224 (FIG. 5), respectively. The first spring fingers 286 of the first and second resonance-control sections 242, 244 are located proximate to the corresponding leading ends 250, 252, respectively. The second spring fingers 288 of the first and second resonance-control sections 242, 244 are located proximate to the base section 240. Each of the first and second spring fingers 286, 288 has a corresponding finger surface 290 that is configured to engage a corresponding ground contact 132.

Also shown in FIG. 6, the base section 240 includes edge projections 292, 294 along the outer edges 282, 284, respectively. Each of the edge projections 292, 294 is configured to engage a corresponding ground contact 132 (FIG. 2). Accordingly, the first and second spring fingers 286, 288 along the outer edge 282 and the edge projection 292 are configured to establish an electrical connection between one of the ground contacts 132 along the first plug side 122 (FIG. 1) and the blade clip 168. The locations of the first and second spring fingers 286, 288 and the edge projection 292 may be configured to achieve a designated electrical performance. Likewise, the first and second spring fingers 286, 288 along the outer edge 284 and the edge projection 294 are configured to establish an electrical connection between one of the ground contacts 132 along the second plug side 124 (FIG. 1) and the blade clip 168. The locations of the edge projection 294 and the first and second spring fingers 286, 288 along the outer edge 284 may be configured to achieve a designated electrical performance as described herein.

Figure 7:
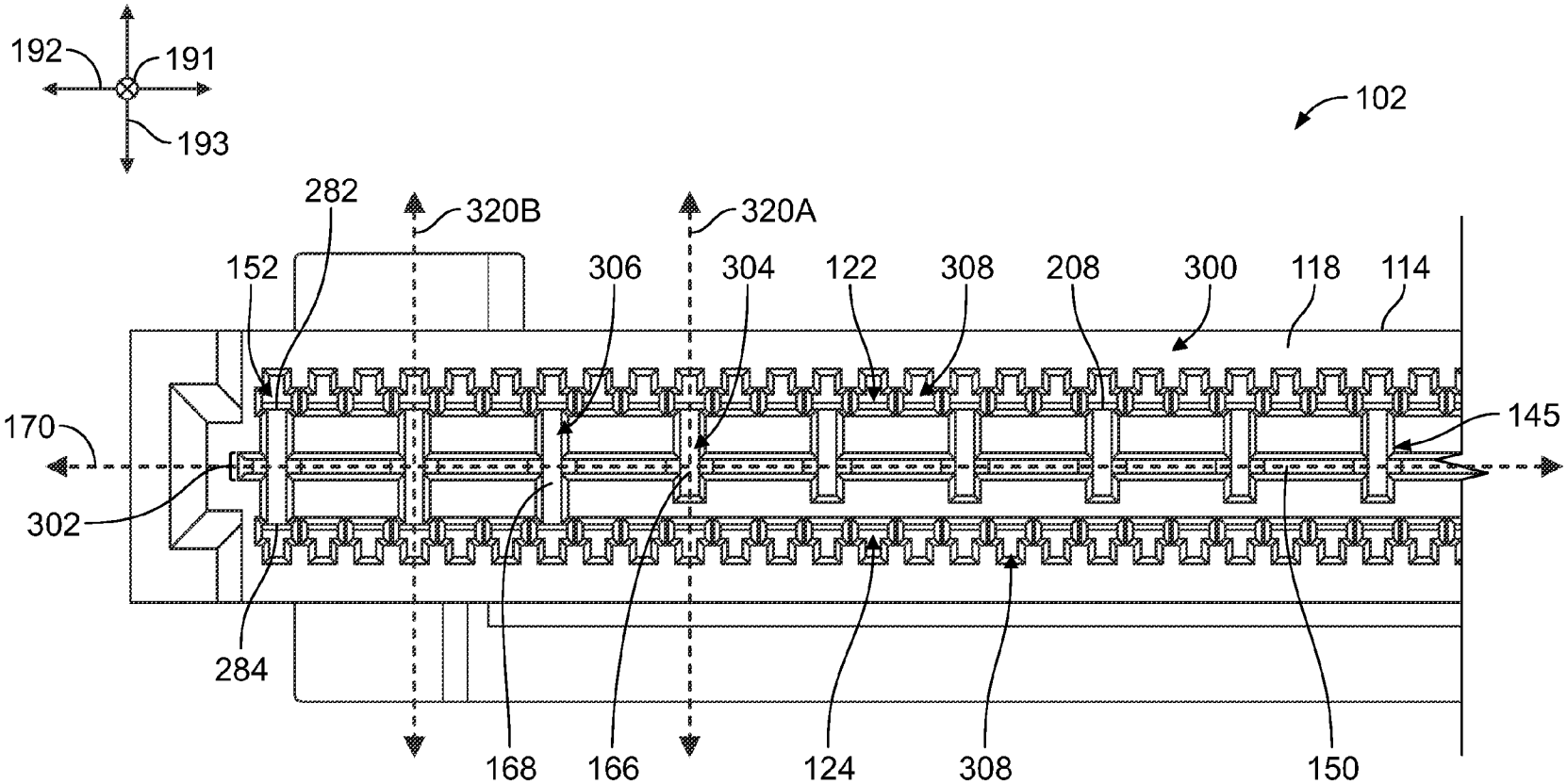
FIG. 7 is an end view of a portion of the pluggable connector of FIG. 1 in which the shield-bus assembly of FIG. 3 has been disposed within a module body of the pluggable connector.

FIG. 7 is a back end view of a portion of the pluggable connector 102. In the illustrated embodiment, the portion shown in FIG. 7 represents only one lateral half of the pluggable connector 102. It should be understood that the other lateral half of the pluggable connector 102 may include similar features. For example, each half of the pluggable connector 102 may include a corresponding shield-bus assembly 145.

The module body 114 includes a loading side 300 and a plurality of cavities that open along the loading side 300 for inserting the shield-bus assembly 145 and the signal and ground contacts 130, 132 (FIG. 2). More specifically, the module body 114 includes a plate cavity 302, a plurality of blade cavities 304, 306, and contact channels 308. The contact channels 308 are sized and shaped to receive the corresponding signal and ground contacts 130, 132. The contact channels 308 extend longitudinally along the mating axis 191.

The plate cavity 302 is sized and shaped to receive the ground plate 150 and extends along the lateral axis 192 and the mating axis 191. The blade cavities 304 are configured to receive the resonance-control blades 166, and the blade cavities 306 are configured to receive the blade clips 168. The blade cavities 304, 306 extend along the elevation axis 193 and the mating axis 191. The plate cavity 302 intersects and extends perpendicular to the blade cavities 304, 306.

The resonance-control blades 152 are positioned along the first and second plug sides 122, 124. The first and second plug sides 122, 124 are located behind the loading portion 118 of the module body 114 in FIG. 7 and are visible through the contact channels 308. Each resonance-control blade 152 coincides with a corresponding ground plane. For example, a ground plane 320A is shown that coincides with a resonance-control blade 166, and a ground plane 320B is shown that coincides with a blade clip 168. The ground planes 320A, 320B are orthogonal or perpendicular to the plate plane 170.

In some embodiments, the resonance-control blades 166 and the blade clips 168 may be inserted into the respective blade cavities 304, 306 after the ground plate 150 is inserted into the plate cavity 302. In other embodiments, however, the shield-bus assembly 145 may be assembled, as shown in FIG. 3, and inserted into the module body 114 as a unit. As shown, the outer edges 208 of the resonance-control blades 166 are exposed along the first plug side 122. The outer edges 282, 284 of the blade clips 168 are exposed along the first and second plug sides 122, 124, respectively.

Figure 8:
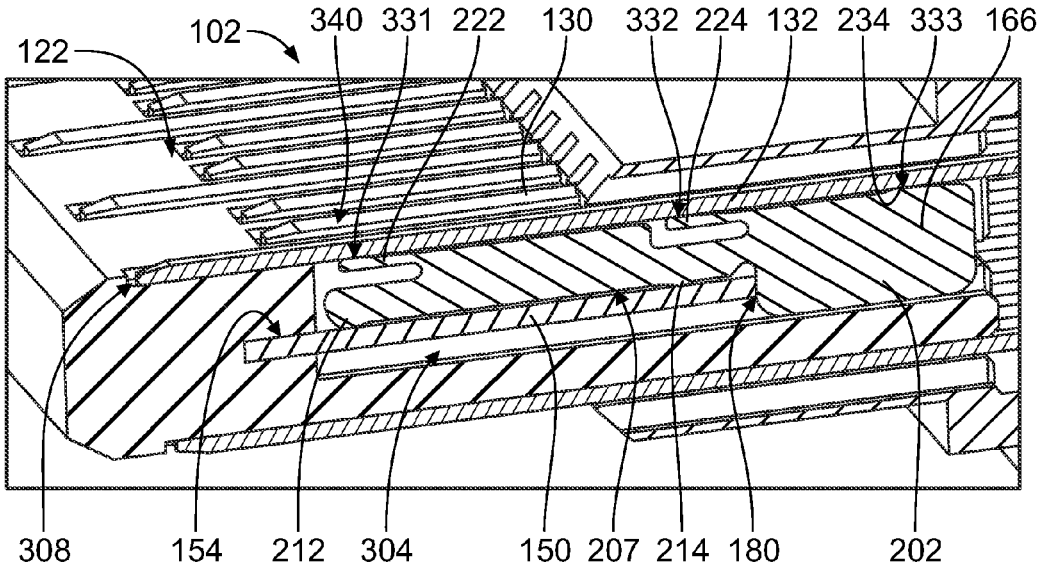
FIG. 8 is a perspective view of a cross-section of the pluggable connector of FIG. 1 illustrating the resonance-control blade of FIG. 5 interconnecting the ground plate and a corresponding ground contact.

FIG. 8 is a perspective view of a cross-section of the pluggable connector 102 taken through one of the blade cavities 304. FIG. 8 illustrates the pluggable connector 102 after the signal and ground contacts 130, 132 have been inserted into the contact channels 308. As shown, the resonance-control blade 166 is disposed within the blade cavity 304 and coplanar with a corresponding ground contact 132. The inner edge 207 directly interfaces with the first plate side 154 of the ground plate 150. The edge projections 212, 214 engage the ground plate 150. In an exemplary embodiment, the base section 202 is disposed within a corresponding blade slot 180 and engaged to the protuberances 184 (FIG. 4). In alternative embodiments, the ground plate 150 does not include the blade slot 180. In such embodiments, the resonance-control blade 166 may only extend from the ground plate 150 to the corresponding ground contact 132 along the first plug side 122.

The resonance-control blade 166 engages the corresponding ground contact 132 along the first plug side 122 at contact areas 331, 332, 333. More specifically, the first spring finger 222 engages the ground contact 132 at the contact area 331, and the second spring finger 224 engages the ground contact 132 at the contact area 332. The edge projection 234 of the base section 202 engages the ground contact 132 at the contact area 333. As such, the resonance-control blade 166 engages the corresponding ground contact 132 along the first plug side 122 at multiple locations that are spaced apart from each other.

In the illustrated embodiment, the contact area 331 is located proximate to a mating area 340 of the signal contacts 130. The mating area 340 may represent the area at which the signal contacts 130 engage corresponding contacts of the receptacle assembly. The locations of the contact areas 331, 332, 333 may be positioned along the ground contact 132 to achieve a designated electrical performance. More specifically, the contact areas 331-333 may be located to impede the development of resonating conditions that negatively affect throughput and/or signal quality. In other embodiments, the contact area 331 may be disposed closer to the contact area 332 and/or the contact area 332 may be disposed closer to the contact area 333.

Figure 9:
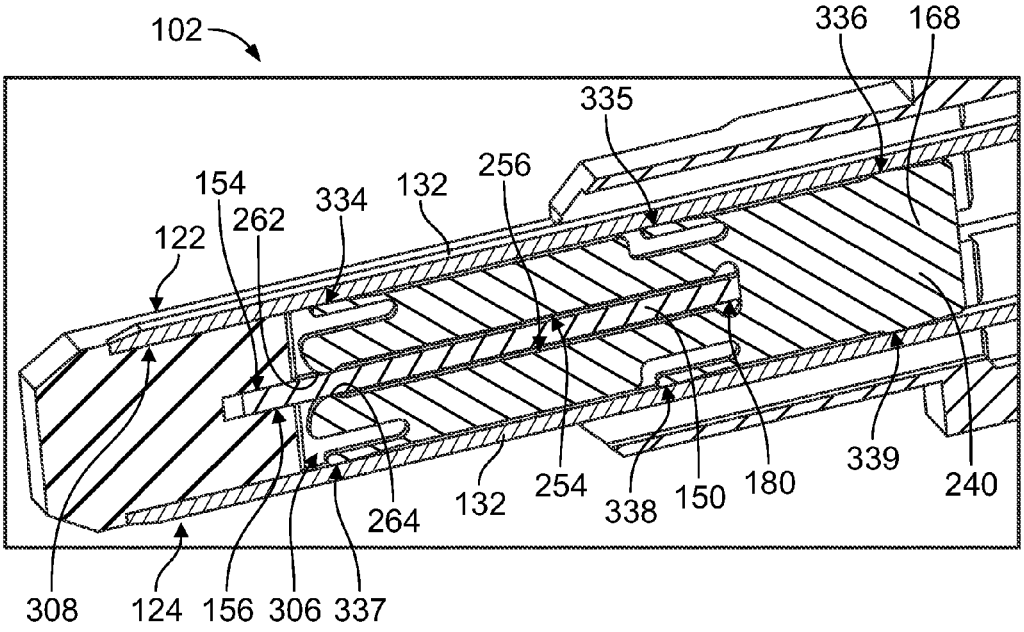
FIG. 9 is a perspective view of a cross-section of the pluggable connector of FIG. 1 illustrating the resonance-control blade of FIG. 6 interconnecting the ground plate and corresponding ground contacts.

FIG. 9 is a perspective view of a cross-section of the pluggable connector 102 taken through one of the blade cavities 306 after the ground contacts 132 have been inserted into the corresponding contact channels 308. As shown, the blade clip 168 is disposed within the blade cavity 306 and coplanar with a corresponding ground contact 132 along the first plug side 122 and a corresponding ground contact 132 along the second plug side 124. The inner edges 254, 256 directly interface with the first and second plate sides 154, 156, respectively, of the ground plate 150. More specifically, the edge projections 262, 264 engage the first and second plate sides 154, 156, respectively, of the ground plate 150. The base section 240 is disposed within a corresponding blade slot 180 and engaged to the protuberances 184 (FIG. 4).

The blade clip 168 and the corresponding spring fingers and edge projections engage the ground contacts 132 in a similar manner as described above with respect to FIG. 8 and the resonance-control blade 166. More specifically, the blade clip 168 engages the corresponding ground contact 132 along the first plug side 122 at contact areas 334, 335, 336. The blade clip 168 engages the corresponding ground contact 132 along the second plug side 124 at contact areas 337, 338, 339. As described above, the locations of the contacts areas 334-339 may be positioned to achieve a designated electrical performance. For example, the contact areas 334-339 may be located to impede the development of resonating conditions that negatively affect throughput and/or signal quality.

Figure 10:
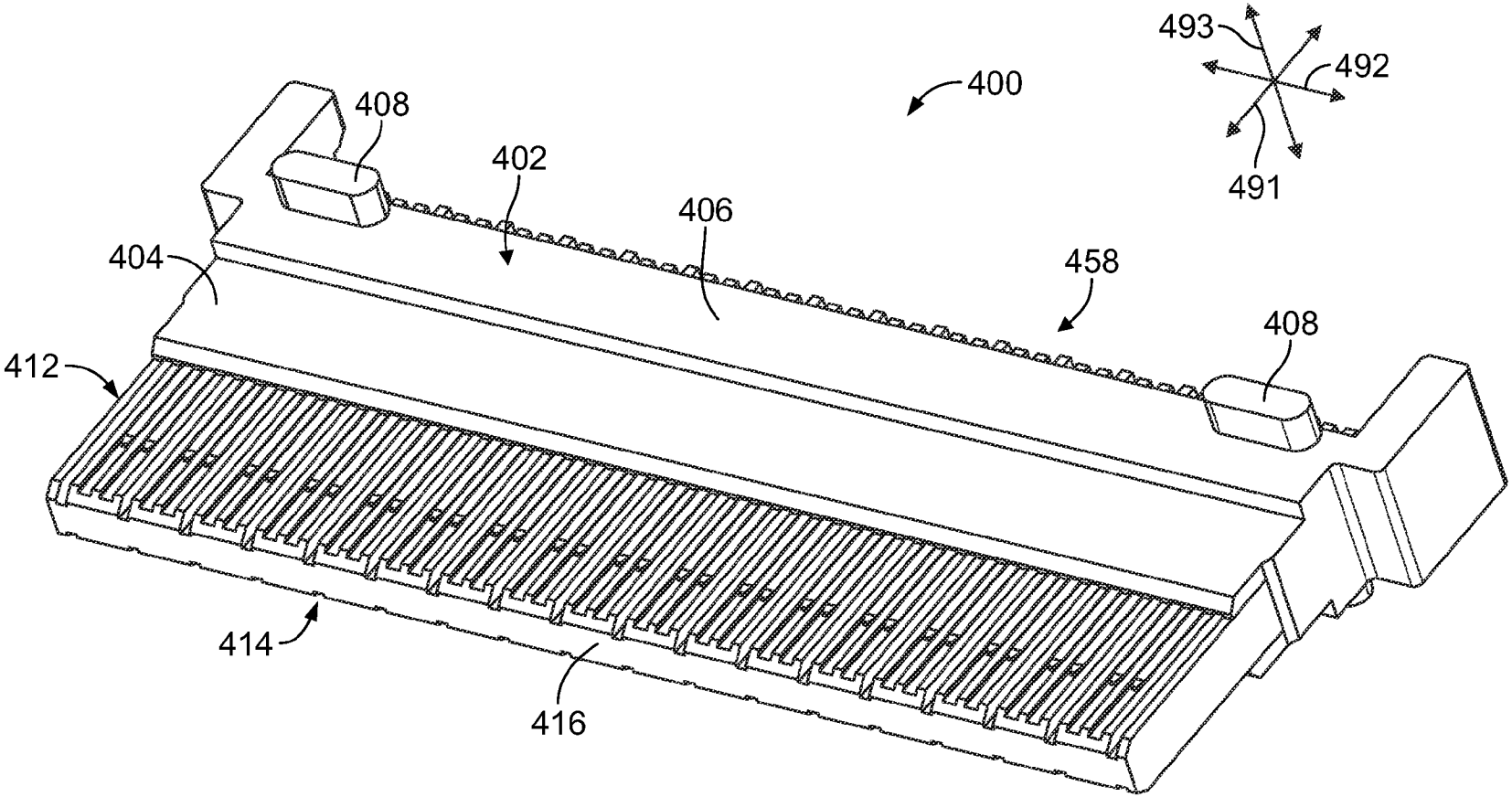
FIG. 10 is an isolated perspective view of a pluggable connector formed in accordance with an embodiment.

FIG. 10 is an isolated perspective view of a pluggable connector 400 formed in accordance with an embodiment. The pluggable connector 400 may form part of a cable assembly (not shown), such as the cable assembly 100 (FIG. 1), and be mechanically and electrically coupled to a circuit board (not shown), such as the circuit board 104 (FIG. 1). In FIG. 10, the pluggable connector 400 is oriented with respect to mutually perpendicular axes 491, 492, 493, including a mating axis 491, a lateral axis 492, and an elevation axis 493. The pluggable connector 400 may be configured for various applications and may be configured to be compliant with certain standards, such as, but not limited to, the SFP standard, the SFP+ standard, the QSFP standard, the CFP standard, and the XFP standard.

The pluggable connector 400 has a module body 402 that includes a mating plug 404 and an outer housing 406. In the illustrated embodiment, the mating plug 404 and the outer housing 406 are discrete components that are coupled to each other to form the module body 402. The outer housing 406 includes coupling projections 408 that are configured to engage an assembly housing (not shown), such as the assembly housing 106 (FIG. 1). The mating plug 404 is configured to be advanced in a mating direction along the mating axis 491 and inserted into a receptacle assembly (not shown).

The mating plug 404 has first and second plug sides 412, 414 that face in opposite directions along the elevation axis 493 and a front edge 416 that joins the first and second plug sides 412, 414 and extends along the lateral axis 492. The front edge 416 is configured to lead the mating plug 404 into a receiving cavity (not shown) of the receptacle assembly during a mating operation. The module body 402 has a loading side 458 that is opposite the front edge 416. The loading side 458 is configured to interface with the circuit board (not shown). The loading side 458 may be formed from the outer housing 406 and, optionally, a portion of the mating plug 404.

Figure 11:
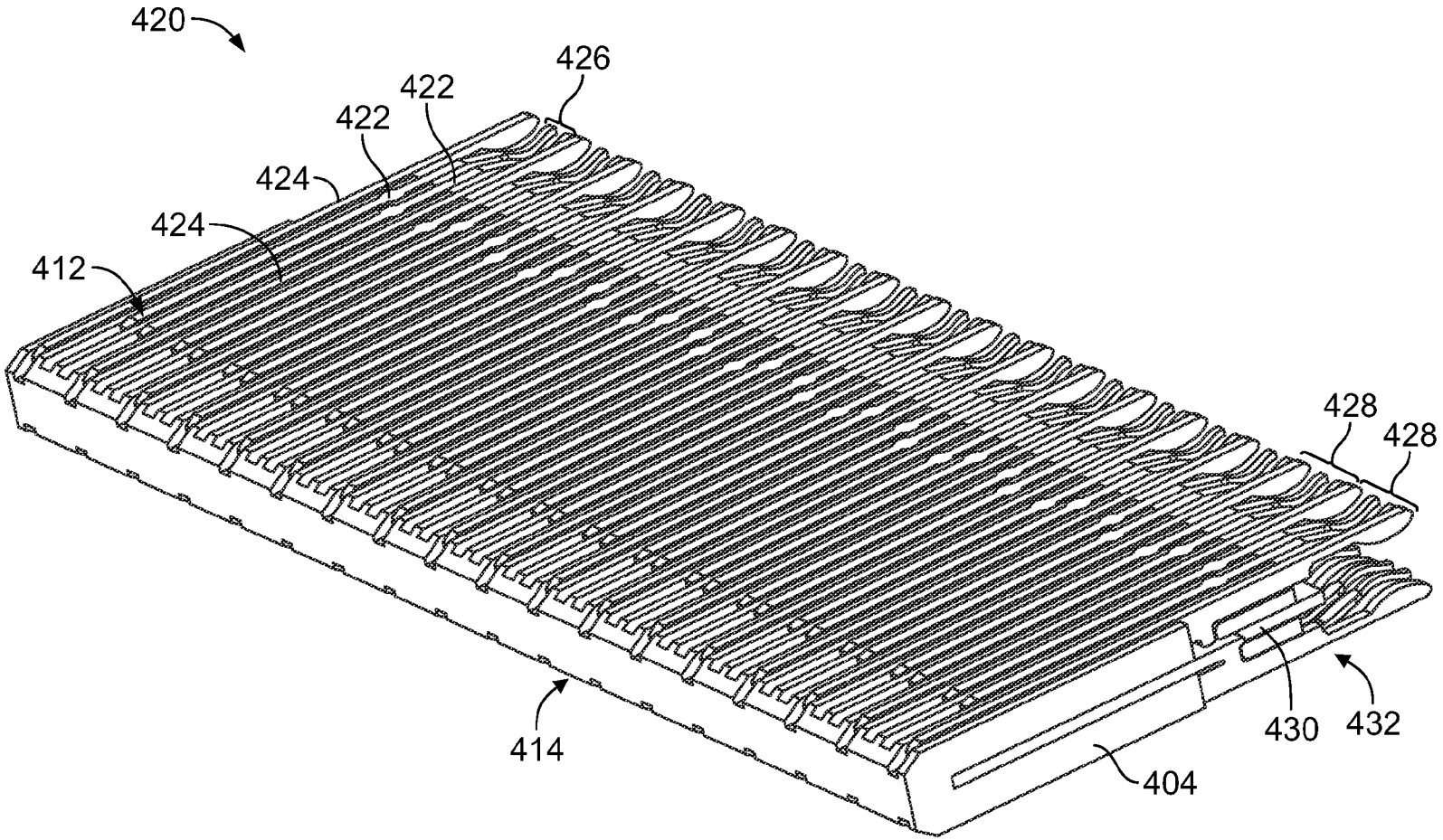
FIG. 11 is an isolated perspective view of a connector sub-assembly that may be used with the pluggable connector of FIG. 10.

FIG. 11 is an isolated perspective of a connector sub-assembly 420 that includes the mating plug 404 and signal and ground contacts 422, 424 positioned along the first and second plug sides 412, 414. In the illustrated embodiment, the signal contacts 422 are elongated strips of sheet metal, and the ground contacts 424 are planar blades that are larger than the signal contacts 422. More specifically, the ground contacts 424 are shaped to extend a depth into the mating plug 404 to engage a ground plate 430 disposed within the mating plug 404. The ground contacts 424 may also be referred to as resonance-control blades or contacts. The ground plate 430 extends parallel to and between the first and second plug sides 412, 414. The ground plate 430 is positioned between the signal contacts 422 along the first plug side 412 and the signal contacts 422 along the second plug side 414.

In the illustrated embodiment, the signal contacts 422 are arranged to form signal pairs 426. The ground contacts 424 are interleaved between the signal pairs 426. The signal and ground contacts 422, 424 are arranged in a repeating pattern such that a single ground contact 424 is interleaved between two signal pairs 426. In other embodiments, the signal and ground contacts 422, 424 may be arranged in a repeating pattern such that two ground contacts 424 are interleaved between two signal pairs 426. As such, the signal and ground contacts 422, 424 may form GSSG sub-arrays 428 in which each signal pair 426 is flanked on both sides by one or more ground contacts 424. In alternative embodiments, the signal contacts 422 may not be arranged in signal pairs 426. For example, the contacts may alternate between signal contacts 422 and ground contacts 424 (e.g., G-S-G-S-G-S).

The ground plate 430 and the ground contacts 424 may form a shield-bus assembly 432 that is disposed within the mating plug 404. The shield-bus assembly 432 is configured to electrically separate the signal contacts 422 of the first plug side 412 and the signal contacts 422 of the second plug side 414 thereby reducing crosstalk. In addition to reducing crosstalk, the shield-bus assembly 432 is configured to impede the development of a resonating condition developed by the ground contacts 424. To this end, the shield-bus assembly 432 may electrically common at least some of the ground contacts 424.

Figure 12:
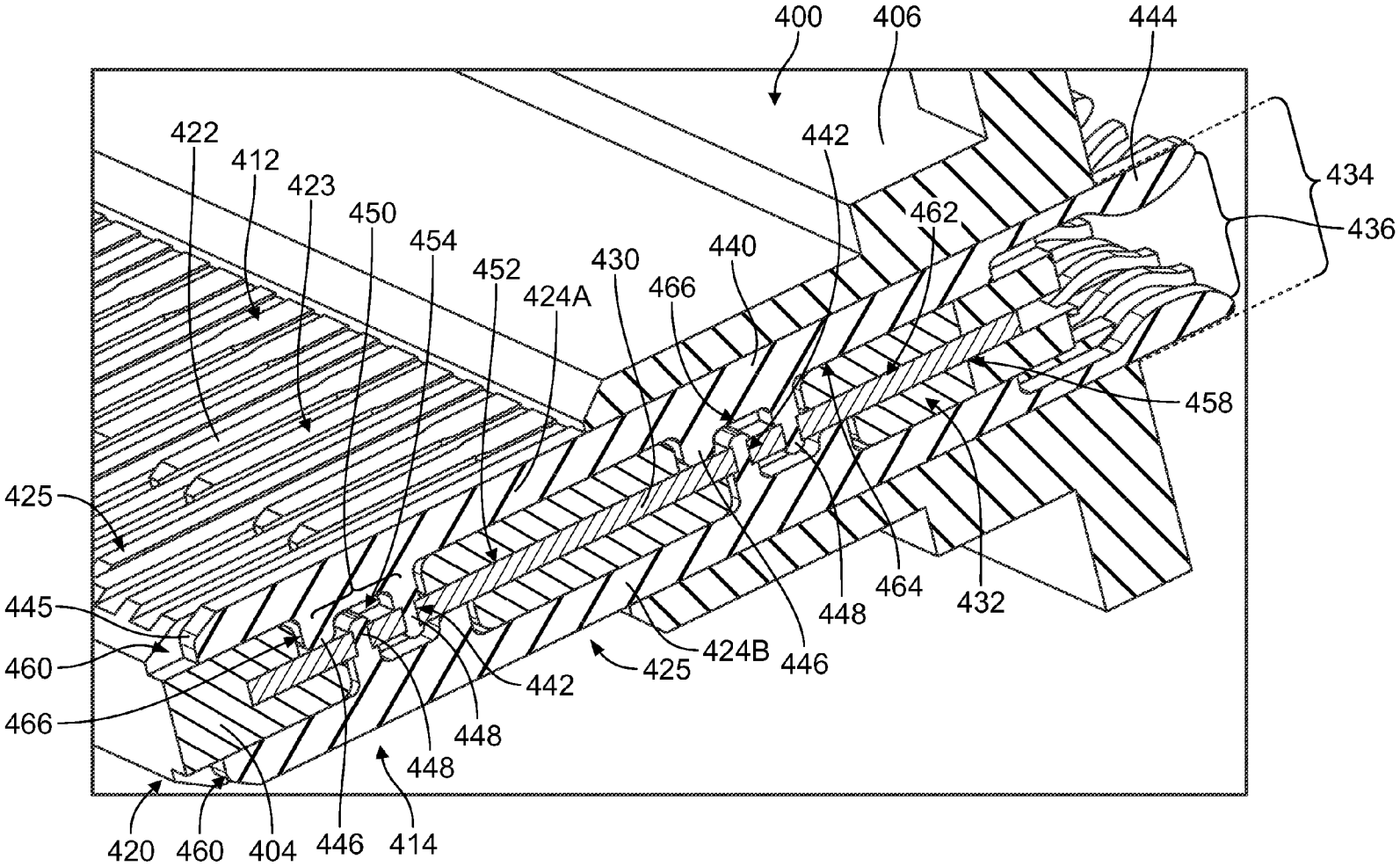
FIG. 12 illustrates a cross-section of the pluggable connector of FIG. 10.

FIG. 12 illustrates a perspective view of a cross-section of the pluggable connector 400. As shown, the connector sub-assembly 420 is disposed within a passage 434 of the outer housing 406. The outer housing 406 and the connector sub-assembly 420 may form an interference fit. In the illustrated embodiment, the shield-bus assembly 432 includes the ground plate 430 and a plurality of ground contacts 424A, 424B, which are hereby referred to as resonance-control blades 424A, 424B. The resonance-control blades 424A, 424B have corresponding outer edges 425 that are exposed along the first and second plug sides 412, 414, respectively. The outer edges 425 of the resonance-control blades 424A are coplanar with outer edges 423 of the signal contacts 422 positioned along the first plug side 412. Although not shown, the outer edges 425 of the resonance-control blades 424B may be coplanar with outer edges 423 of the signal contacts 422 positioned along the second plug side 414. The outer edges 425 are configured to engage corresponding contacts of a receptacle assembly (not shown). Thus, unlike the resonance-control blades 152 (FIG. 3), the resonance-control blades 424A, 424B function as ground contacts that engage the corresponding contacts of the receptacle assembly.

The resonance-control blades 424A, 424B also engage the ground plate 430. The ground plate 430 includes a plurality of designated recesses 442 that are configured to receive portions of the resonance-control blades 424A, 424B. In the illustrated embodiment, the recesses 442 are thru-holes that extend entirely through the ground plate 430. In other embodiments, however, the recess 442 may not extend completely through the ground plate 430.

In the illustrated embodiment, the mating plug 404 includes a plurality of blade cavities 460 that open along the first plug side 412 and a plurality of blade cavities 460 that open along the second plug side 414. The mating plug 404 also includes a plate cavity 462 that opens along the loading side 458. Prior to the connector sub-assembly 420 being inserted into the passage 434, the connector sub-assembly 420 may be at least partially assembled by inserting the ground plate 430 into the plate cavity 462 through the loading side 458. The resonance-control blades 424A may be inserted into the blade cavities 460 along the first plug side 412, and the resonance-control blades 424B may be inserted into the blade cavities 460 along the second plug side 414. As the resonance-control blades 424A, 424B are inserted into the corresponding blade cavities 460, the resonance-control blades 424A, 424B may engage the ground plate 430.

Although the following is described with particular reference to the resonance-control blade 424A, it should be understood that the description may also be applied to the resonance-control blade 424B. The resonance-control blade 424A includes an elongated contact body 440 that extends from a terminating segment 444 to a mating end 445. The terminating segment 444 is configured to be mechanically and electrically coupled to a circuit board (not shown). The resonance-control blade 424A has an inner edge 464 that interfaces with the mating plug 404 and also the ground plate 430. The resonance-control blade 424A includes a plurality of edge projections 446, 448 that extend away from the contact body 440 toward the ground plate 430. The edge projections 446, 448 extend into plug cavities 466 of the mating plug 404 and engage the ground plate 430. For example, the edge projection 446 engages or interfaces with a first plate side 452 of the ground plate 430. The edge projections 448 extend through the recesses 442. In some embodiments, the edge projections 448 may form an interference fit with the ground plate 430.

The edge projections 446, 448 may be positioned at designated locations along the contact body 440 to impede the development of resonating conditions. In the illustrated embodiment, the edge projections 446, 448 form projection pairs 450 in which each edge projection 446 is located proximate to an edge projection 448 such that a projection gap 454 is formed therebetween. In the illustrated embodiment, the edge projection 448 from the ground contact 424B extends through a corresponding recess 442 and into the projection gap 454. In the illustrated embodiment, the resonance-control blade 424A includes two edge projections 446 and two edge projections 448. The resonance-control blades 424A, however, may include a different number of edge projections in other embodiments.

After the connector sub-assembly 420 is inserted into the passage 434 of the outer housing 406, the outer housing 406 may engage the outer edges 425 of the resonance-control blades 424A, 424B to facilitate securing the resonance-control blades 424A, 424B to the mating plug 404. In the illustrated embodiment, the resonance-control blades 424A, 424B form blade pairs 436 in which each blade pair 436 includes one resonance-control blade 424A and one resonance-control blade 424B. The resonance-control blades 424A, 424B of the blade pair 436 are coplanar. In other embodiments, one or more of the resonance-control blades 424A may not be coplanar with a corresponding resonance-control blade 424B.

It is to be understood that the above description is intended to be illustrative, and not restrictive. Moreover, the above-described embodiments (and/or aspects thereof) may be used in combination with each other. In addition, many modifications may be made to adapt a particular situation or material to the teachings of the various embodiments without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The patentable scope should, therefore, be determined with reference to the appended claims, along with the full scope of equivalents to which such claims are entitled.

As used in the description, the phrase "in an exemplary embodiment" and the like means that the described embodiment is just one example. The phrase is not intended to limit the inventive subject matter to that embodiment. Other embodiments of the inventive subject matter may not include the recited feature or structure. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. A pluggable connector comprising:

a module body having a mating plug that is configured to be inserted into a receptacle assembly during a mating operation, the mating plug having first and second plug sides that face in opposite directions and a front edge that joins the first and second plug sides, the front edge leading the mating plug into the receptacle assembly during the mating operation;

a plurality of signal contacts positioned along the first and second plug sides;

a ground plate disposed within the mating plug, the ground plate extending parallel to and between the first and second plug sides, the ground plate being positioned between the signal contacts along the first plug side and the signal contacts along the second plug side; and a plurality of resonance-control blades disposed within the mating plug and extending from the ground plate to at least one of the first plug side or the second plug side, wherein the resonance-control blades have edge projections that engage the ground plate.

2. The pluggable connector of claim 1, wherein the resonance-control blades have outer edges, the outer edges being one of (a) exposed along the first and second plug sides and interleaved between the signal contacts or (b) engaged to discrete ground contacts of the pluggable connector that are positioned along the first and second plug sides and interleaved between the signal contacts.

3. The pluggable connector of claim 1, further comprising a plurality of discrete ground contacts positioned along the first and second plug sides and interleaved between the signal contacts, each of the resonance-control blades being coplanar with and engaging at least one of the ground contacts.

4. The pluggable connector of claim 3, wherein each of the resonance-control blades has a plurality of outer edge projections along an outer edge of the corresponding resonance-control blade that engage the at least one ground contact.

5. The pluggable connector of claim 4, wherein the plurality of the edge projections include at least one spring finger that is deflected by the at least one ground contact.

6. The pluggable connector of claim 1, wherein the resonance-control blades include a blade clip having first and second resonance-control sections, the first resonance-control section extending from the ground plate to the first plug side, the second resonance-control section extending from the ground plate to the second plug side, the blade clip having a base section that joins the first and second resonance-control sections.

7. The pluggable connector of claim 6, wherein the first and second resonance-control sections are coplanar and define a plate-receiving slot therebetween, the ground plate being positioned within the plate-receiving slot.

8. The pluggable connector of claim 1, wherein the resonance-control blades have outer edges that are exposed along the first and second plug sides and coplanar with outer edges of the signal contacts of the first and second plug sides, respectively, the outer edges being interleaved between the signal contacts.

9. The pluggable connector of claim 1, further comprising a circuit board, each of the signal contacts extending between a mating end and a terminating segment, the terminating segments being terminated to the circuit board, the mating ends configured to interface with corresponding contacts of the receptacle assembly.

10. The pluggable connector of claim 1, wherein the pluggable connector is configured to transmit data at a rate of at least 20 Gigabits/second (Gbps).

11. A pluggable connector comprising:

a module body having a mating plug that is configured to be inserted into a receptacle assembly during a mating operation, the mating plug having first and second plug sides that face in opposite directions and a front edge that joins the first and second plug sides, the front edge leading the mating plug into the receptacle assembly during the mating operation;

signal and ground contacts positioned along the first plug side and along the second plug side, the ground contacts being interleaved between the signal contacts;

a ground plate extending parallel to and between the first and second plug sides through the mating plug, the ground plate being positioned between the signal and ground contacts along the first plug side and the signal and ground contacts along the second plug side; and a plurality of resonance-control blades disposed within the mating plug and extending from the ground plate to at least one of the first plug side or the second plug side, wherein the resonance-control blades have inner edges that engage the ground plate and outer edges that engage corresponding ground contacts.

12. The pluggable connector of claim 11, wherein each of the resonance-control blades has a plurality of edge projections positioned along the corresponding outer edge, the edge projections engaging the corresponding ground contact.

13. The pluggable connector of claim 12, wherein the edge projections include at least one spring finger that is deflected by the corresponding ground contact.

14. The pluggable connector of claim 11, wherein the resonance-control blades include a blade clip having first and second resonance-control sections, the first resonance-control section extending from the ground plate to the first plug side, the second resonance-control section extending from the ground plate to the second plug side, the blade clip including a base section that joins the first and second resonance-control sections.

15. The pluggable connector of claim 11, wherein the mating plug has a plurality of blade cavities and a plate cavity, the plate cavity intersecting and extending perpendicular to the blade cavities, the blade cavities and the plate cavity being accessed through a loading side of the mating plug.

16. A pluggable connector comprising:

a module body having a mating plug that is configured to be inserted into a receptacle assembly during a mating operation, the mating plug having first and second plug sides that face in opposite directions and a front edge that joins the first and second plug sides, the front edge leading the mating plug into the receptacle assembly during the mating operation;

signal contacts positioned along the first and second plug sides;

a ground plate disposed within the mating plug, the ground plate extending parallel to and between the first and second plug sides, the ground plate being positioned between the signal contacts along the first plug side and the signal contacts along the second plug side; and a plurality of resonance-control blades disposed within the mating plug and extending from the ground plate to the first plug side, each resonance-control blade having an inner edge that engages the ground plate and an outer edge that is exposed along the first plug side, the outer edges being coplanar with and interleaved between outer edges of the signal contacts along the first plug side, each of the inner edges of the resonance-control blades having an edge projection that engages the ground plate.

17. The pluggable connector of claim 15, wherein the ground plate includes recesses that receive the edge projections.

18. The pluggable connector of claim 16, wherein the recesses include thru-holes, at least some of the edge projections extending through the thru-holes and engaging the ground plate.

19. The pluggable connector of claim 15, wherein the mating plug has a loading side that is opposite the front edge, the mating plug having blade cavities that open to the first plug side or the second plug side and a plate cavity that opens to the loading side, wherein the ground plate is configured to be inserted into the plate cavity from the loading side and the resonance-control blades are configured to be inserted into the blade cavities from one of the first plug side or the second plug side.

20. The pluggable connector of claim 15, wherein the resonance-control blades are first resonance-control blades, the pluggable connector further comprising a plurality of second resonance-control blades disposed within the mating plug and extending between the ground plate and the second plug side, each second resonance-control blade having an inner edge that engages the ground plate and an outer edge that is exposed along the second plug side, the outer edges of the second resonance-control blades being coplanar with and interleaved between outer edges of the signal contacts along the second plug side.

* * * * *